United States Patent [19]

Beerbaum

[11] Patent Number: 4,749,469

[45] Date of Patent: Jun. 7, 1988

[54] PROCESS CONTROL SYSTEM FOR MULTI-REACTOR HYDROCARBON CONVERSION PROCESSES

[75] Inventor: Alfred W. Beerbaum, Walnut Creek, Calif.

[73] Assignee: Chevron Research Company, San Francisco, Calif.

[21] Appl. No.: 54,544

[22] Filed: May 27, 1987

[51] Int. Cl.[4] ..... C10G 51/02; G05D 11/00

[52] U.S. Cl. ..... 208/72; 208/75; 208/49; 208/DIG. 1; 422/109; 422/110; 196/132; 196/134; 165/35

[58] Field of Search ..... 208/DIG. 1, 106, 113, 208/108, 72, 75, 76, 48 Q, 49; 422/109, 110, 118, 207; 196/132, 134; 165/34, 35

[56] References Cited

U.S. PATENT DOCUMENTS

| | | | |
|---|---|---|---|
| 2,100,048 | 11/1937 | Beatie | 208/76 |
| 2,154,795 | 4/1939 | Westenberg | 196/134 X |
| 2,203,025 | 6/1940 | Morrell | 208/72 X |
| 2,357,531 | 9/1944 | Mather et al. | 196/132 X |
| 3,979,183 | 9/1976 | Scott | 208/DIG. 1 |
| 4,501,057 | 2/1985 | Nollkamper | 208/DIG. 1 |
| 4,544,788 | 10/1985 | Daviduk et al. | 208/DIG. 1 |
| 4,621,062 | 11/1986 | Stewart et al. | 422/110 X |

*Primary Examiner*—Helen M. S. Sneed

*Assistant Examiner*—Glenn Caldarola

*Attorney, Agent, or Firm*—S. R. La Paglia; E. J. Keeling; E. A. Schaal

[57] ABSTRACT

A temperature control process is disclosed for a hydrocarbon conversion process wherein a feedstock is heated in a furnace and is partly converting in a first reactor, the effluent from the first reactor is cooled in a first heat exchanger and by adding a quench, then the cooled effluent is converted in a second reactor, and the effluent from the second reactor is cooled in a second heat exchanger. Part of the pre-furnace feedstock is used as coolant for the two heat exchangers, the amount of coolant being controlled by a first bypass valve for a line bypassing both heat exchangers and by a second bypass valve for a line bypassing only the second heat exchanger. The inlet temperature for the second reactor is controlled while maximizing the pre-furnace feedstock temperature by adjusting the valve for quench and the two bypass valves. To raise the inlet temperature, the second bypass valve is substantially closed before closing the quench valve, and the quench valve is substantially closed before opening the first bypass valve. To lower the inlet temperature, the first bypass valve is substantially closed before opening the quench valve, and the quench valve is substantially opened before opening the second bypass valve.

5 Claims, 4 Drawing Sheets

PROCESS CONTROL SYSTEM FOR MULTI-REACTOR HYDROCARBON CONVERSION PROCESSES

The present invention relates to a process for temperature control of a multi-reactor hydrocarbon processing unit.

BACKGROUND OF THE INVENTION

Historically, reactors were designed in single reactor modules having separate furnaces for each reactor, but the ever-rising price of energy has caused much interest in integrated reactor systems that maximize energy savings.

One such process is a lube oil hydrofinisher process involving a dewaxing reactor and a finisher reactor. These two reactors are connected in series, with only one furnace. In this process, a feedstock is heated in the furnace, then the heated feedstock is dewaxed in a dewaxing reactor, the effluent from the dewaxing reactor is cooled in a first heat exchanger then further cooled by adding a quench, then the cooled effluent is finished in a finisher reactor, and the effluent from the finisher reactor is cooled in a second heat exchanger. Part of the pre-furnace feedstock is used as coolant for the two heat exchangers, the amount of coolant being controlled by a first bypass valve for a line bypassing both heat exchangers and by a second bypass valve for a line bypassing only the second heat exchanger.

While such a process, by being integrated, has major energy cost savings it is more difficult to control. Because of its integrated nature, moving one valve has an effect on both reactors. Since each valve has a multiple effect on the system, there is more than one way of controlling temperatures in such a process. But there is only one combination of positions that maximizes energy savings. For instance, in this process it is desirable to maximize the pre-furnace feedstock temperature so as to reduce the amount of energy that has to enter the system through the furnace. Therefore, it is desirable to have a control process that controls the temperatures of the system in such a way to maximize the pre-furnace feedstock temperature while maintaining stable control.

SUMMARY OF THE INVENTION

The present invention is a process for temperature control in a hydrocarbon conversion process wherein a feedstock is heated in a furnace, then the heated feedstock is partly converting in a first reactor, the effluent from the first reactor is cooled in a first heat exchanger then further cooled by adding a quench, then the cooled effluent is converted in a second reactor, and the effluent from the second reactor is cooled in a second heat exchanger. Part of the pre-furnace feedstock is used as coolant for the two heat exchangers, the amount of coolant being controlled by a first bypass valve for a line bypassing both heat exchangers and by a second bypass valve for a line bypassing only the second heat exchanger.

The present invention involves controlling the inlet temperature for the second reactor while maximizing the pre-furnace feedstock temperature by adjusting the valve for quench and the two bypass valves. To raise the inlet temperature, the second bypass valve is substantially closed before closing the quench valve, and the quench valve is substantially closed before opening the first bypass valve. To lower the inlet temperature, the first bypass valve is substantially closed before opening the quench valve, and the quench valve is substantially opened before opening the second bypass valve.

The second heat exchanger effluent exit temperature is also controlled while controlling the inlet temperature for the second reactor. To lower the exit temperature, both bypass valves are incrementally closed. To raise the exit temperature, both bypass valves are incrementally opened.

In one embodiment of the present invention, part of the effluent from the first reactor can bypass the first heat exchanger by going through a third bypass valve. In that embodiment, to raise the inlet temperature, the second bypass valve is substantially closed before closing the quench valve, the quench valve is substantially closed before opening the third bypass valve, and the third bypass valve is substantially opened before opening the first bypass valve. To lower the inlet temperature, the first bypass valve is substantially closed before closing the third bypass valve, the third bypass valve is substantially closed before opening the quench valve, and the quench valve is substantially opened before opening the second bypass valve. In this embodiment the second heat exchanger effluent exit temperature is controlled while controlling the inlet temperature for the second reactor by incrementally closing the first and second bypass valves to lower the exit temperature, and by incrementally opening those two values to raise the exit temperature.

BRIEF DESCRIPTION OF THE DRAWINGS

In order to facilitate the understanding of this invention, reference will now be made to the appended drawings of preferred embodiments of the present invention. The drawings are exemplary only, and should not be construed as limiting the invention.

DETAILED DESCRIPTION OF THE PREFERRED EMBODIMENTS

In its broadest aspect, the present invention is a process for temperature control of a multi-reactor hydrocarbon processing unit. That multi-reactor hydrocarbon processing unit comprises a furnace for heating a feedstock, a first reactor for partly converting the heated feedstock, a first heat exchanger for cooling the effluent from the first reactor, a quench for further cooling the effluent, a second reactor for converting the cooled effluent, and a second heat exchanger for cooling the effluent from the second reactor. Part of the prefurnace feedstock is used as coolant for the two heat exchangers, the amount of coolant being controlled by a first bypass valve for a line bypassing both heat exchangers and by a second bypass valve for a line bypassing only the second heat exchanger.

By "pre-furnace feedstock," we mean feedstock that has yet to flow into the furnace.

By "pre-furnace feedstock temperature," we mean the temperature of the feedstock just prior to flowing into the furnace.

In the present invention, the inlet temperature for the second reactor is controlled while maximizing the pre-furnace feedstock temperature by adjusting the valve for quench and the two bypass valves. To raise the inlet temperature, the second bypass valve is substantially closed before closing the quench valve, and the quench valve is substantially closed before opening the first bypass valve. To lower the inlet temperature, the first bypass valve is substantially closed before opening the quench valve, and the quench valve is substantially opened before opening the second bypass valve.

By "inlet temperature for the second reactor," we mean the temperature of the cooled effluent from the first reactor just prior to flowing into the second reactor.

In the context of control, when we say that one valve is "substantially opened" or "substantially closed" before opening or closing a second valve we mean that we use the primary valve as the primary control valve until it has substantially reached the limits of its travel. Then, we control by opening or closing a secondary valve. This application is intended to cover those variations and substitutions which may be made by those skilled in the art without departing from the spirit and scope of this invention. For instance, it is intended to cover the slight opening or closing of a secondary valve before the primary control valve is completely opened or completely closed.

The present invention is also used to control the second heat exchanger effluent exit temperature. By "the second heat exchanger effluent exit temperature," we mean the temperature of the effluent from the second reactor as it leaves the second heat exchanger. This temperature is controlled by either incrementally opening or incrementally closing both bypass valves. To lower the exit temperature, both bypass valves are incrementally closed. To raise the exit temperature, both bypass valves are incrementally opened.

Figure 1:
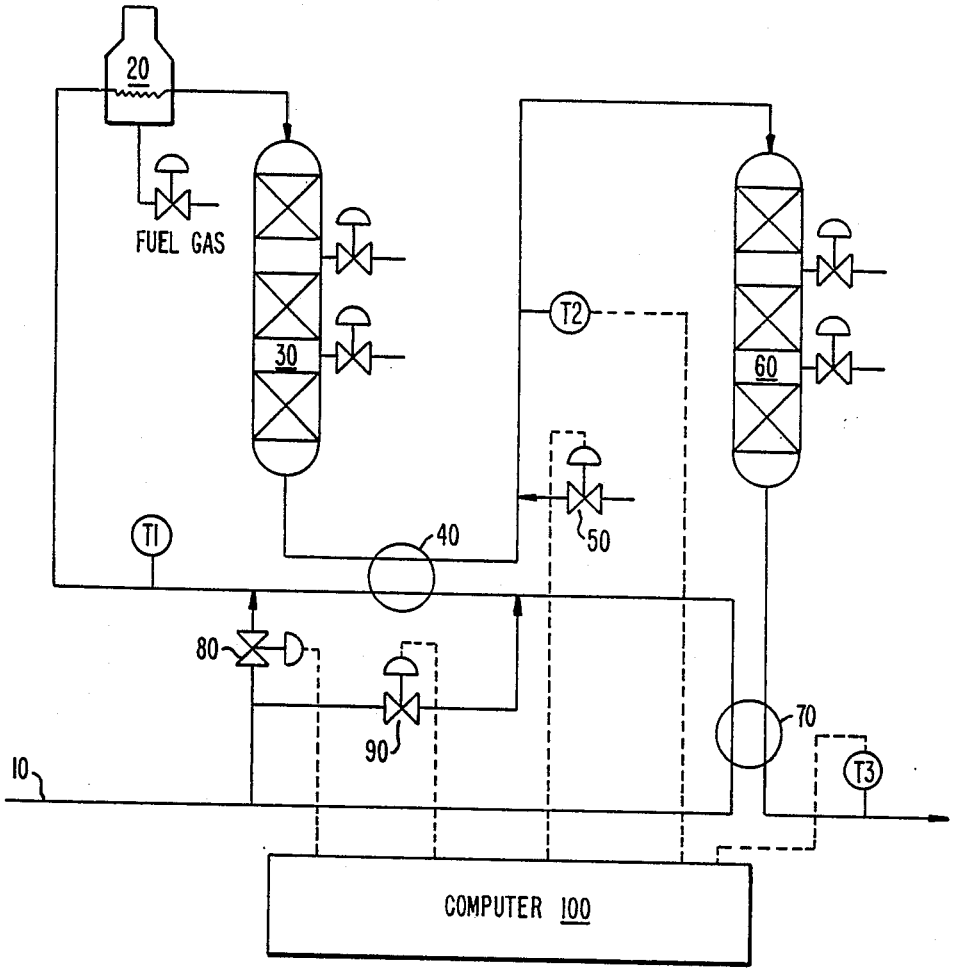
FIG. 1 is a process diagram of one embodiment of the present invention.

Referring to FIG. 1, in one embodiment of the present invention, a hydrocarbon feedstock, such as a waxy lube base stock, is passed through feedstock line 10 to furnace 20, where the feedstock is heated. The feedstock either goes directly to furnace 20 by going through first bypass valve 80, or it first goes through connecting heat exchanger 40 by going through second bypass valve 90, or it first goes through both connecting heat exchanger 40 and exit heat exchanger 70. In either case, the heated feedstock is then passed into first reactor 30 where it is partly converted. In a lube oil hydrofinisher process, the first reactor is a dewaxing reactor wherein the heated feedstock is dewaxed. The effluent from the first reactor is then cooled in connecting heat exchanger 40, and is further cooled by adding a quench gas, such as a hydrogen-rich gas, through quench valve 50. The cooled effluent is then passed to second reactor 60, where the effluent is converted. In a lube oil hydrofinisher process, the second reactor is a finisher reactor. The effluent from the second reactor is then cooled in exit heat exchanger 70. Notice that part of the pre-furnace feedstock is used as coolant for the two heat exchangers, the amount of coolant being controlled by first bypass valve 80 and second bypass valve 90.

Figure 2:
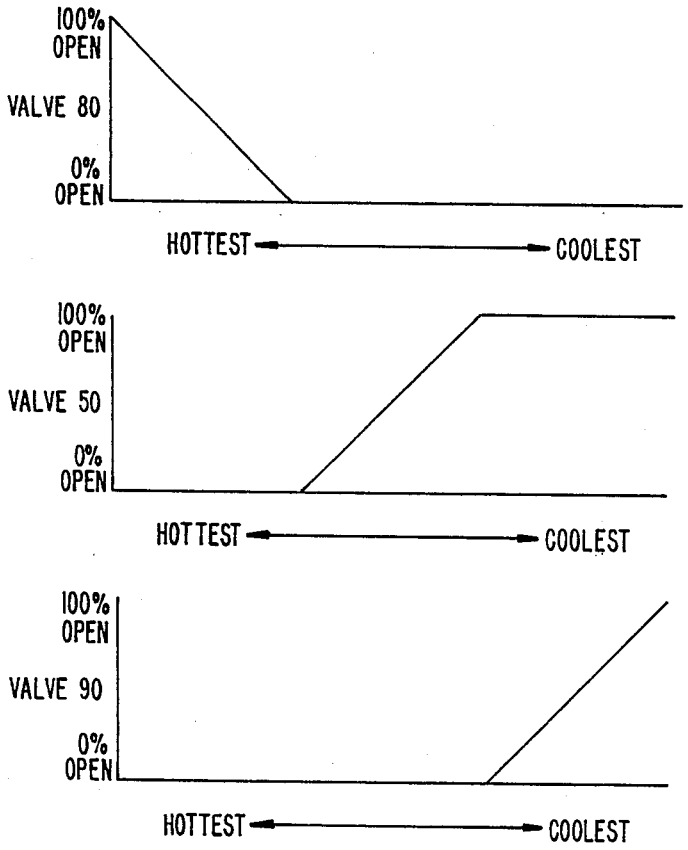
FIG. 2 is a control strategy for moving valves in the embodiment shown in FIG. 1.

The inlet temperature (T2) for the second reactor 60 is controlled by adjusting the quench valve 50 and the two bypass valves 80 and 90. To raise the inlet temperature, the second bypass valve 90 is substantially closed before closing the quench valve 50, and the quench valve 50 is substantially closed before opening the first bypass valve 80. To lower the inlet temperature, the first bypass valve 80 is substantially closed before opening the quench valve 50, and the quench valve 50 is substantially opened before opening the second bypass valve 90. By opening and closing the bypass valves in this order, we maximize the pre-furnace feedstock temperature (T1). This control strategy for moving valves is shown in FIG. 2. Such a control strategy can be readily used in a computer controller 100.

The second heat exchanger effluent exit temperature (T3) is controlled in such a way as to minimize disturbances of temperature T2. To lower the exit temperature T3, both bypass valves 80 and 90 are incrementally closed. To raise the exit temperature T3, both bypass valves 80 and 90 are incrementally opened.

Figure 3:
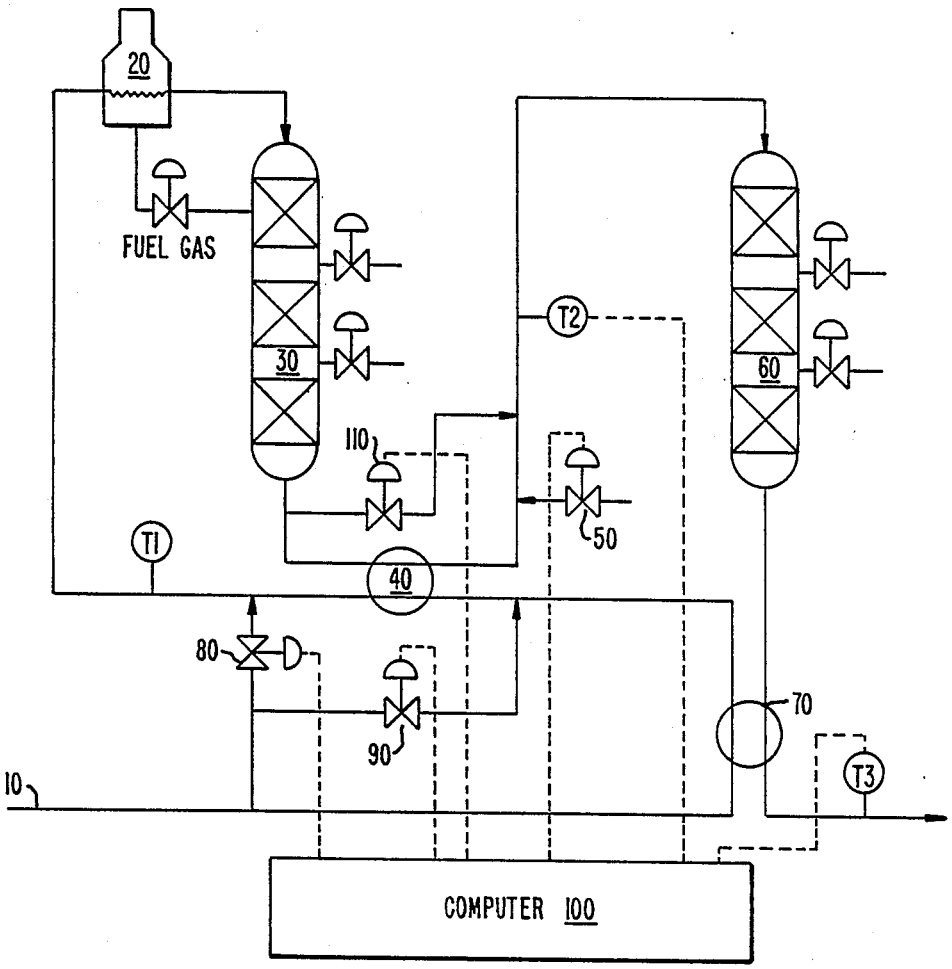
FIG. 3 is a process diagram of a further embodiment of the present invention.
Figure 4:
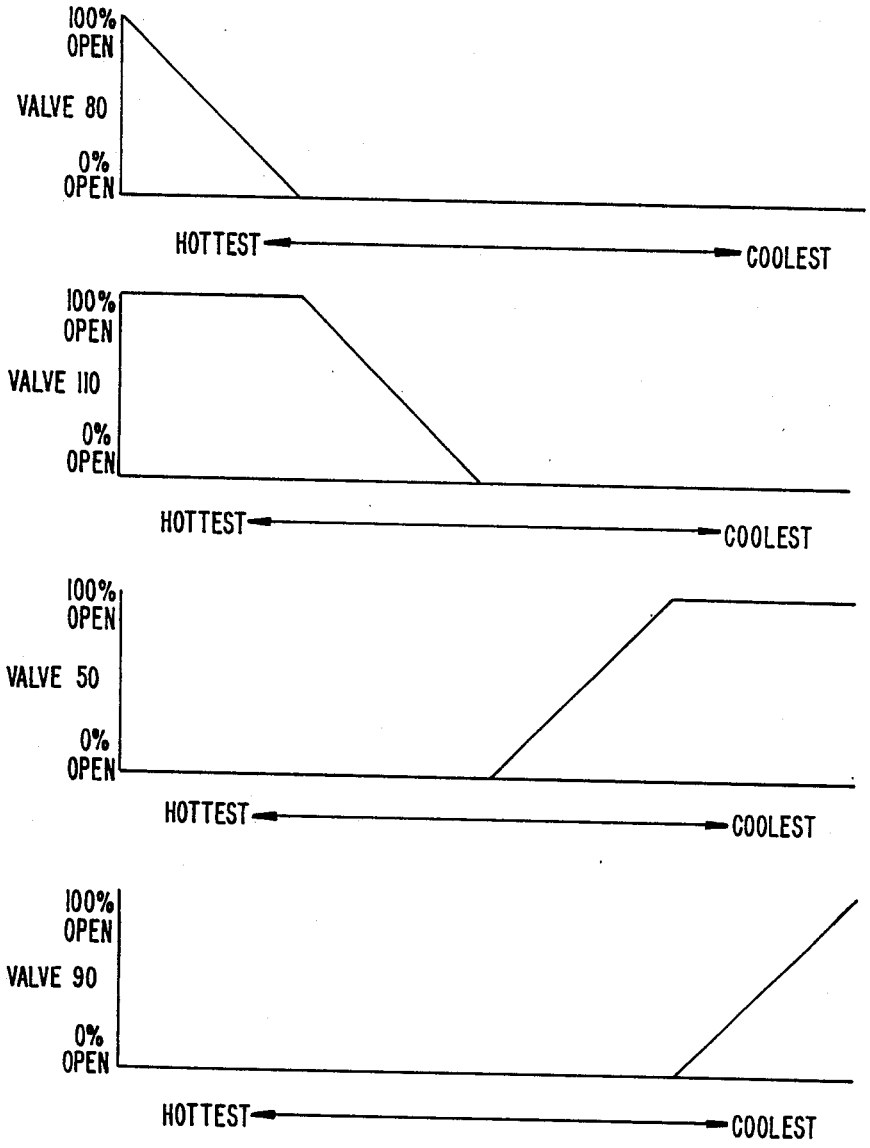
FIG. 4 is a control strategy for moving valves in the embodiment shown in FIG. 3.

In another embodiment, as shown in FIG. 3, part of the effluent from the first reactor 30 can bypass the first heat exchanger 40 by going through a third bypass valve 110. That embodiment is substantially the same as shown in FIG. 1, except for the addition of a third bypass valve 110 and bypass line. In such an embodiment, the inlet temperature for the second reactor T2 is controlled by adjusting the quench valve 50 and the three bypass valves 80, 90, and 110. To raise temperature T2, the second bypass valve 90 is substantially closed before closing the quench valve 50, the quench valve 50 is substantially closed before opening the third bypass valve 110, and the third bypass valve 110 is substantially opened before opening the first bypass valve 80. To lower temperature T2, the first bypass valve 80 is substantially closed before closing the third bypass valve 110, the third bypass valve 110 is substantially closed before opening the quench valve 50, and the quench valve 50 is substantially opened before opening the second bypass valve 90. This control strategy for moving valves is shown in FIG. 4. Such a control strategy can be readily used in a computer controller 100.

While the present invention has been described with reference to specific embodiments, this application is intended to cover those various changes and substitutions which may be made by those skilled in the art without departing from the spirit and scope of the appended claims.

What is claimed is:

1. In a hydrocarbon conversion process comprising:

heating a feedstock in a furnace, partly converting the heated feedstock in a first reactor, cooling the effluent from the first reactor in a first heat exchanger, further cooling the effluent by adding a quench, converting the cooled effluent in a second reactor, and cooling the effluent from the second reactor in a second heat exchanger;

wherein part of the pre-furnace feedstock is used as coolant for the two heat exchangers, the amount of coolant being controlled by a first bypass valve for a line bypassing both heat exchangers and by a second bypass valve for a line bypassing only the second heat exchanger;

the improvement comprising controlling the inlet temperature for the second reactor while maximizing the pre-furnace feedstock temperature by adjusting the valve for quench and the two bypass valves, wherein, to raise the inlet temperature, the second bypass valve is substantially closed before closing the quench valve, and the quench valve is substantially closed before opening the first bypass valve; and wherein, to lower the inlet temperature, the first bypass valve is substantially closed before opening the quench valve, and the quench valve is substantially opened before opening the second bypass valve.

2. The process according to claim 1 wherein the second heat exchanger effluent exit temperature is controlled while controlling the inlet temperature for the second reactor, wherein, to lower the exit temperature, both bypass valves are incrementally closed; and wherein, to raise the exit temperature, both bypass valves are incrementally opened.

3. The process according to claim 1 wherein part of the effluent from the first reactor can bypass the first heat exchanger by going through a third bypass valve.

4. The process according to claim 3 wherein the inlet temperature for the second reactor is controlled while maximizing the pre-furnace feedstock temperature by adjusting the valve for quench and the three bypass valves, wherein, to raise the inlet temperature, the second bypass valve is substantially closed before closing the quench valve, the quench valve is substantially closed before opening the third bypass valve, and the third bypass valve is substantially opened before opening the first bypass valve; and wherein, to lower the inlet temperature, the first bypass valve is substantially closed before closing the third bypass valve, the third bypass valve is substantially closed before opening the quench valve, and the quench valve is substantially opened before opening the second bypass valve.

5. The process according to claim 4 wherein the second heat exchanger effluent exit temperature is controlled while controlling the inlet temperature for the second reactor, wherein, to lower the exit temperature, the first and second bypass valves are incrementally closed; and wherein, to raise the exit temperature, the first and second bypass valves are incrementally opened.

* * * * *